US006732865B2

(12) United States Patent
Mostini

(10) Patent No.: US 6,732,865 B2
(45) Date of Patent: May 11, 2004

(54) TRAY OF MOLDED MATERIAL, IN PARTICULAR FOR FRUIT

(75) Inventor: Serge Mostini, L'Houmeau (FR)

(73) Assignee: Societe des Emballages Keyes, Vix (FR)

( * ) Notice: Subject to any disclaimer, the term of this patent is extended or adjusted under 35 U.S.C. 154(b) by 45 days.

(21) Appl. No.: 10/028,715

(22) Filed: Dec. 28, 2001

(65) Prior Publication Data

US 2003/0121820 A1 Jul. 3, 2003

(30) Foreign Application Priority Data

Dec. 28, 2001 (FR) ..... 00 17237

(51) Int. Cl.[7] ..... B65D 85/34

(52) U.S. Cl. ..... 206/521.6; 206/521.1; 206/507; 206/518

(58) Field of Search ..... 206/506, 507, 206/518, 521.1, 521.6, 521.8, 521.9; 217/26.5; D9/456; 229/406

(56) References Cited

U.S. PATENT DOCUMENTS

| | | | | | |
|---|---|---|---|---|---|
| 1,543,038 | A | * | 6/1925 | Thompson | 217/26.5 |
| 1,983,325 | A | * | 12/1934 | Swift, Jr. | 217/26.5 |
| 3,204,848 | A | * | 9/1965 | Olson et al. | 206/521.1 |
| 3,598,300 | A | * | 8/1971 | Katz | 206/521.8 |
| 3,997,057 | A | * | 12/1976 | Craig | 206/507 |
| 4,012,530 | A | | 3/1977 | Holden | |

FOREIGN PATENT DOCUMENTS

| | | |
|---|---|---|
| DE | 94 14 117 | 12/1994 |
| FR | 1 297 869 | 11/1962 |
| JP | 10 218153 | 8/1998 |
| NL | 103 179 | 10/1962 |
| WO | WO 99/01058 | 1/1999 |

* cited by examiner

*Primary Examiner*—David T. Fidei
(74) *Attorney, Agent, or Firm*—Young & Thompson

(57) ABSTRACT

A tray of molded material, in particular for fruit, comprising cells for receiving individual fruits, wherein the cells are disposed in successive rows of high cells and of low cells, the high cells and the low cells also presenting a relative disposition in a staggered configuration.

6 Claims, 3 Drawing Sheets

TRAY OF MOLDED MATERIAL, IN PARTICULAR FOR FRUIT

BACKGROUND OF THE INVENTION

The packaging of fruit in a box or a case requires the following to be taken into account:

the different sizes of existing fruit;

optimum packing of fruit per tray, all sizes together; and possible optimization of fruit weight for packaging in boxes or cases, whatever the size of the packaged fruit.

Known trays for packaging fruit are not designed to receive fruit of all sizes, so it is necessary to have several types of tray with cells of different sizes.

Furthermore, known trays with rows of cells placed side by side are capable of receiving only a relatively small weight of fruit.

OBJECTS AND SUMMARY OF THE INVENTION

The invention seeks to mitigate the above-mentioned drawbacks of conventional fruit trays by creating a fruit tray that enables fruit of different sizes to be packed.

The invention also seeks to create a fruit tray that enables a greater weight of fruit to be packed than is possible using state-of-the-art trays.

The invention thus provides a tray of molded material, in particular for fruit, comprising cells for receiving individual fruits, wherein the cells are disposed in successive rows of high cells and of low cells, the high cells and the low cells also presenting a relative disposition in a staggered configuration.

According to other characteristics of the invention:

the low cells in a row along a first dimension of the tray are touching whereas those in a row along a second dimension of the tray are spaced apart at regular intervals;

the high cells in each row along the short dimension of the tray are spaced apart from one another by a first interval whereas the cells of high cell rows along the long dimension of the tray are spaced apart from one another by a second interval different from the first interval;

the high cells in each row along the short dimension of the tray and the high cells along the long dimension of the tray are spaced apart from one another at equal intervals;

the depth of the high cells is less than the depth of the low cells;

the tray is made of molded fibers;

the tray is made of polystyrene or of polyurethane; and the tray is made by injection.

BRIEF DESCRIPTION OF THE DRAWINGS

The invention will be better understood on reading the following description given purely by way of example and made with reference to the accompanying drawings, in which.

MORE DETAILED DESCRIPTION

Figure 1:
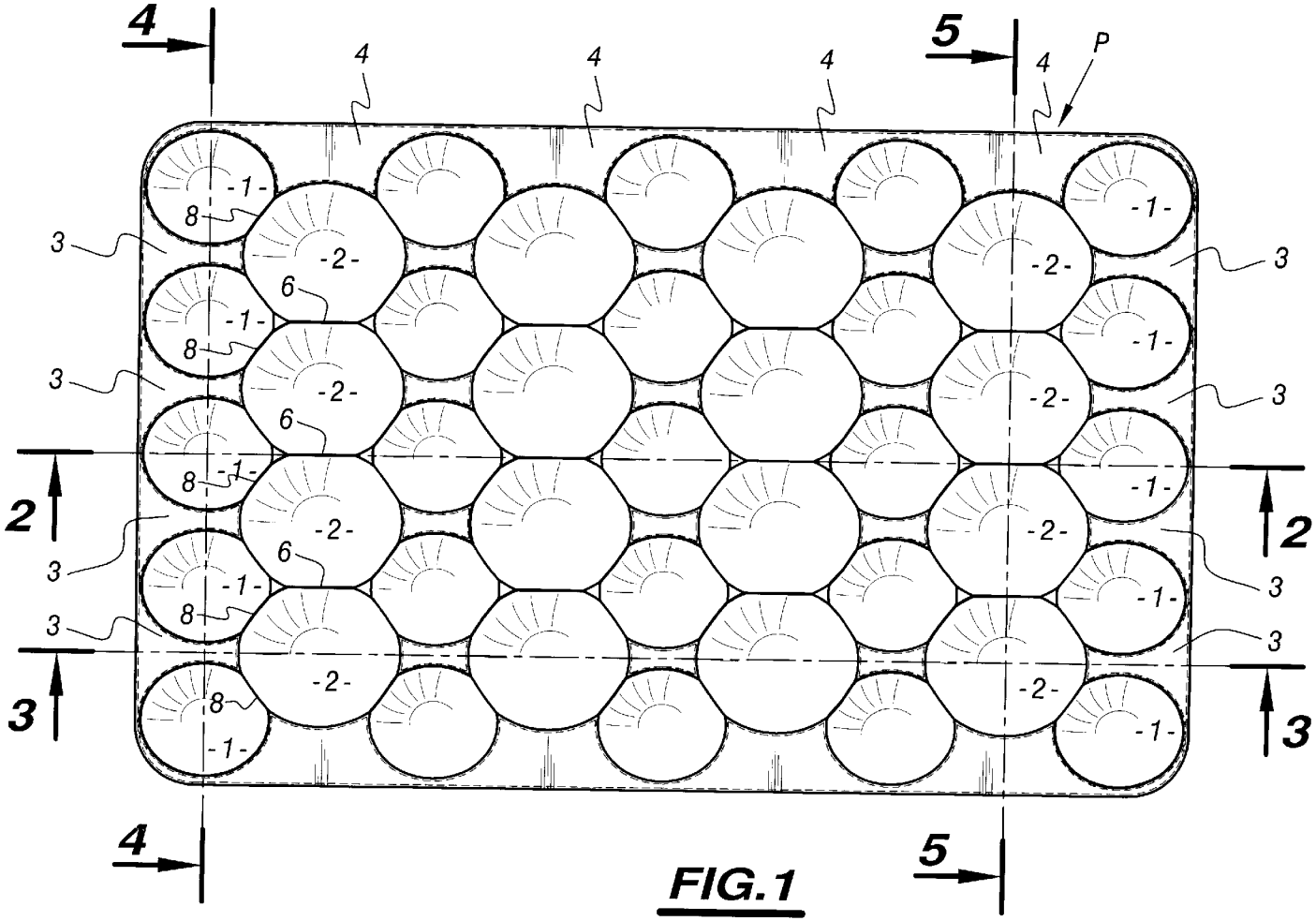
FIG. 1 is a plan view of a fruit tray of the invention.

The fruit tray P shown in FIG. 1 has high cells 1 and low cells 2.

The respective depths of the high and low cells 1 and 2 can be seen clearly in the section views of FIGS. 2 to 5.

It can be seen in particular in these figures that the depth and the section of the high cells 1 are smaller than the depth and the section of the low cells 2.

The high cells 1 and the low cells 2 are disposed in adjacent rows so that a row of low cells 2 is situated between two rows of high cells 1, and vice versa.

It can be seen that in the embodiment of FIG. 1, the low cells 2 in a row extending along a first or short dimension of the tray P touch one another whereas the cells in a row along a second or long dimension of the tray are spaced apart at regular intervals.

The high cells 1 in each row along the short dimension of the tray P are spaced apart from one another by a first interval 3, whereas the cells in the rows of high cells along the long dimension of the tray are spaced apart from one another by a second interval 4 greater than the interval 3.

Naturally, it is possible for the intervals 3 and 4 to be equal or indeed for the intervals 3 to be greater than the intervals 4.

Furthermore, it can be seen that in the general disposition of the tray, each low cell 2 is surrounded by four high cells 1 so as to form a staggered configuration. This staggered configuration is also applicable for each high cell 1 surrounded by four low cells 2.

In the example shown in FIG. 1, the low cells 2 in the same row along the short dimension of the tray P come into contact with one another in pairs in zones 6. Furthermore, each low cell 7 comes into contact with the corresponding four high cells in the staggered configuration via zones 8.

By way of example, the tray P is made of molded fibers and as a result its intrinsic stiffness is better than that of conventional trays.

It can also be made by injection or by any other conventional method.

The tray can also be made of molded or injected plastics material, e.g. of polystyrene, of polyurethane, or of some other material.

The relative disposition of the rows of high and low cells 1 and 2 is clearly shown in FIGS. 2 to 5 in directions along both dimensions of the tray.

Figure 2:
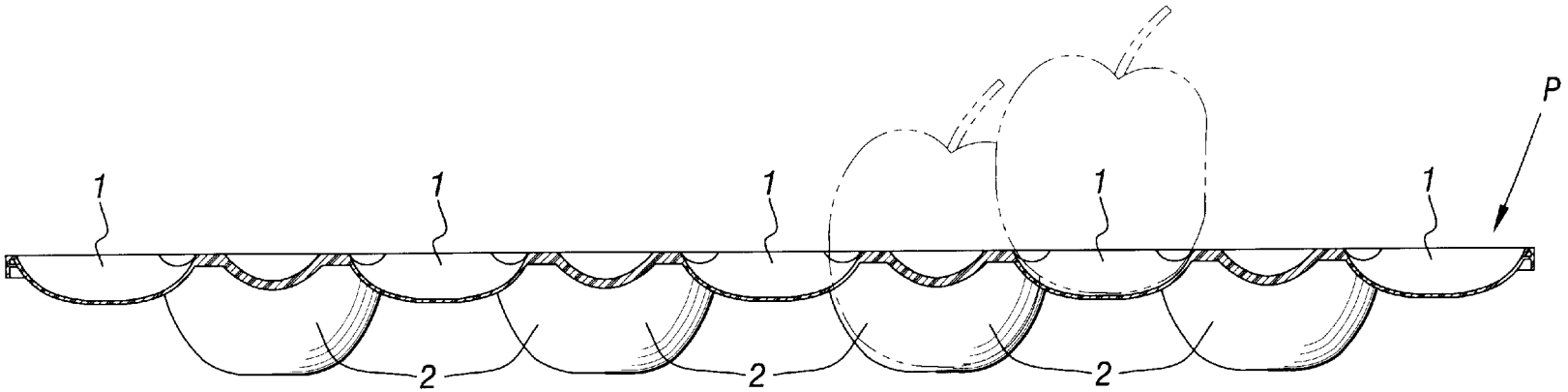
FIG. 2 is a section view on line 2—2 of FIG. 1.
Figure 3:
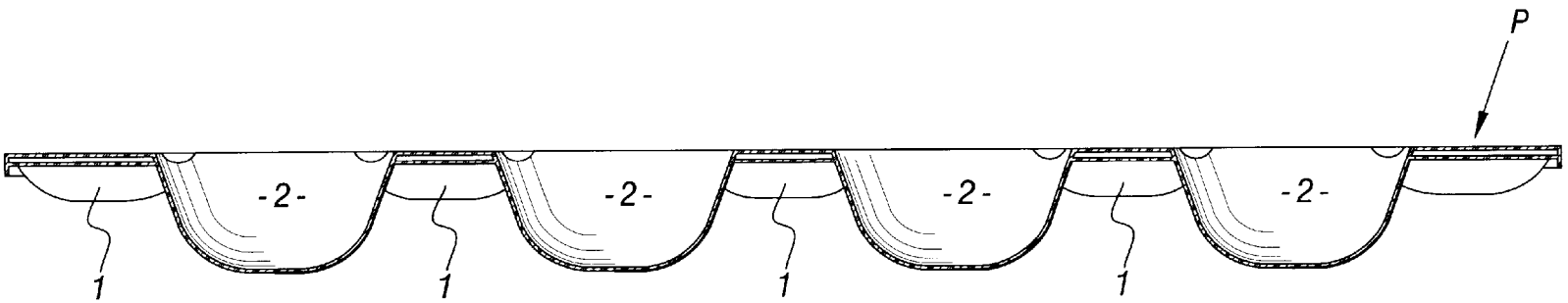
FIG. 3 is a section view on line 3—3 of FIG. 1.
Figure 4:
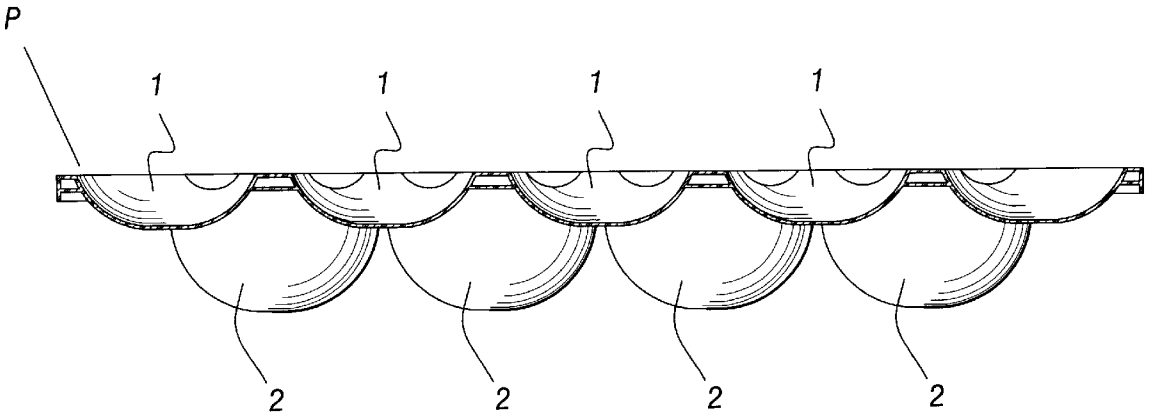
FIG. 4 is a section view on line 4—4 of FIG. 1.
Figure 5:
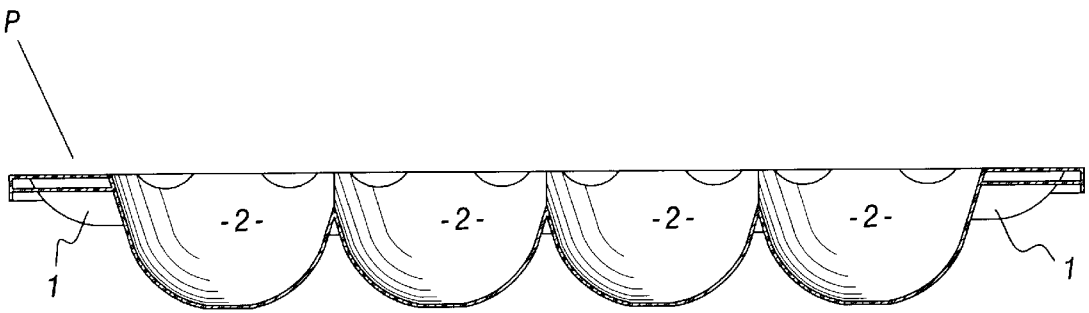
FIG. 5 is a section view on line 5—5 of FIG. 1.

In particular, it can be seen in FIG. 2 that fruit F placed in high cells 1 and in low cells 2 are located at different levels, such that the volume occupied by the fruit on a single tray is greater than the volume occupied by the fruit on a conventional tray having identical rows all at the same depth.

Given the staggered configuration of the shallow and low cells 1 and 2, and with reference to FIG. 1, it can also be seen that the surface area of the tray that is occupied by fruit is considerably increased compared with the surface area occupied in conventional trays.

The relative staggered configuration of the high and low cells 1 and 2 of the tray enables such a tray to receive an optimum weight of fruit that is about 30% greater than the weight received by conventional trays.

Furthermore, the tray of the invention presents the following advantages.

It can receive fruit of various sizes and it can be placed in different types of box or case.

The tray of the invention presents good ability to receive all sizes because the centers of the individual fruits are offset alternately in the vertical direction in rows.

The individual fruits are not wedged against one another.

It is easier to take fruit off the tray on a stall because the rows of cells and consequently the rows of fruit are high and low in alternation.

Although the tray as described above is a fruit tray, such a tray could also be used for packaging other goods, whether foodstuffs or otherwise.

What is claimed is:

1. A tray of molded material for packaging fruit, comprising:

a plurality of individual cells for receiving individual fruits;

the cells being disposed in successive rows of high cells and of low cells;

the high cells and the low cells presenting a relative disposition in a staggered configuration;

the low cells in a row along a first dimension of the tray touching, whereas the low cells in a row along a second dimension of the tray being spaced apart at regular intervals;

the high cells in each row along a short dimension of the tray being spaced apart from one another by a first interval, whereas the high cells in each row along a long dimension of the tray being spaced apart from one another by a second interval; and the high cells having a depth which is smaller than the depth of the low cells.

2. The tray according to claim 1, wherein the first and second intervals are different.

3. The tray according to claim 1, wherein the first and second intervals are equal.

4. The tray according to claim 1, wherein the tray is made of molded fibers.

5. The tray according to claim 1, wherein the tray is made of polystyrene or of polyurethane.

6. The tray according to claim 5, wherein the tray is made by injection.

* * * * *

UNITED STATES PATENT AND TRADEMARK OFFICE

CERTIFICATE OF CORRECTION

PATENT NO. : 6,732,865 B2
DATED : May 11, 2004
INVENTOR(S) : Serge Mostini

It is certified that error appears in the above-identified patent and that said Letters Patent is hereby corrected as shown below:

Title page,
Item [30], should read as follows:
-- [30] Foreign Application Priority Data
Dec. 28, 2000 (FR) ……00 17237 --.

Signed and Sealed this

Sixth Day of July, 2004

JON W. DUDAS
*Acting Director of the United States Patent and Trademark Office*